US006997644B2

(12) United States Patent
Fleeger

(10) Patent No.: US 6,997,644 B2
(45) Date of Patent: Feb. 14, 2006

(54) PASSIVE METHOD FOR OBTAINING CONTROLLED DRAINAGE FROM A VESSEL

(76) Inventor: Howard W. Fleeger, 7512 Marwood Pl., Woodinville, WA (US) 98072-9731

( * ) Notice: Subject to any disclaimer, the term of this patent is extended or adjusted under 35 U.S.C. 154(b) by 0 days.

(21) Appl. No.: 10/675,709

(22) Filed: Sep. 29, 2003

(65) Prior Publication Data

US 2005/0036840 A1 Feb. 17, 2005

Related U.S. Application Data

(60) Provisional application No. 60/494,451, filed on Aug. 11, 2003.

(51) Int. Cl.
*E02B 7/20* (2006.01)

(52) U.S. Cl. ..... 405/96

(58) Field of Classification Search ..... 405/96
See application file for complete search history.

(56) References Cited

U.S. PATENT DOCUMENTS 706,526 A * 8/1902 Carlisle ..... 405/88
3,792,499 A * 2/1974 Whitaker ..... 4/512
3,966,604 A * 6/1976 Diggs ..... 210/104
4,015,629 A * 4/1977 Morgan et al. ..... 137/578
4,094,338 A * 6/1978 Bauer ..... 137/578
5,378,376 A * 1/1995 Zenner ..... 210/776
6,391,202 B1 * 5/2002 Knobloch et al. ..... 210/603
6,453,483 B1 9/2002 Jacuzzi et al. ..... 4/507
6,647,804 B1 * 11/2003 Deines ..... 73/861.18

FOREIGN PATENT DOCUMENTS

JP 2003147844 A * 5/2003

* cited by examiner

*Primary Examiner*—Frederick L. Lagman
(74) *Attorney, Agent, or Firm*—Gary C Cohn PLLC

(57) ABSTRACT

Passive control of fluid flow from a vessel is provided by a floating weir assembly. The assembly includes a float and a weir opening that is in fluid communication with an outlet from the vessel. The weir opening and the fluid path connecting the weir opening and the outlet are designed such that the rate of outflow is determined by the geometry and position of the weir opening. The weir opening is preferably vertically adjustable so that desired outflow rates can be specified.

27 Claims, 6 Drawing Sheets

PASSIVE METHOD FOR OBTAINING CONTROLLED DRAINAGE FROM A VESSEL

This application claims benefit to provisional application Ser. No. 60/494,451, Aug. 11, 2003.

BACKGROUND OF THE INVENTION

This invention relates to methods for controlling the rate of flow of a fluid from a vessel.

There are many instances in which it is necessary to control the rate of flow of fluids from a vessel. Rain water detainment systems, for example, are commonly used to control the rate at which rain water drains from a developed property. The systems generally include a reservoir into which rain water is collected, and one or more drains through which water is discharged from the reservoir. Maximum permissible flow rates out of these systems are generally specified by local regulatory bodies, and are usually keyed to the amount of rainfall.

Rainfall is often expressed in terms of how frequently particular amounts of rainfall would be expected at a particular location. A rainfall that occurs on average once every two years, for example, is referred to as a "two-year storm" or "two-year rainfall". The probability of such a storm occurring once in a particular year is considered to be 50%, that of such a storm occurring twice in a particular year is considered to be 25%, and so forth. A larger rainfall that occurs on average once every 10 years is referred to as a "10-year storm"—the probability of such a storm occurring in a particular year is 10%. Even larger rainfalls may be categorized as "50-year" or "500-year" rainfalls, for example. Typical regulatory schemes will specify maximum allowable drainage rates in these terms. For example, a code may specify that rainfall equal to or greater than that of a 2-year storm, but less than that of a 10-year storm, may drain from the developed property at the same rate at which rainfall from a 2-year storm would have drained from the undeveloped property. In turn, rainfall equal to or greater than that of a 10-year storm but less than that of a 50-year storm may be drained at the rate at which rainfall from a 10-year storm would have drained from the undeveloped property, and so forth for larger storms. The specifics of the regulatory scheme will vary from jurisdiction to jurisdiction.

The drain(s) controls the rate of water discharge in these detainment systems. By sizing and positioning the drains appropriately, water drainage from the reservoir can be controlled so that it does not exceed a predetermined maximum flow rate. Detainment systems frequently have multiple drains, some of which are not active unless some minimum amount of rainfall is experienced. For instance, a system may have a drain that operates when any rainfall is received, and a second drain that operates only if, for example, rainwater from a 10-year storm is received.

The drains in these detainment systems are typically gravity-fed, open-channel systems. Pumps can be used to manage flow rates from the reservoir, but these increase installation, maintenance and operating costs. In addition, electrical pumps will not operate if power is lost, as often happens during periods of rain because of lightning, winds, automobile accidents and other weather-related causes. Gravity-feed drains are inexpensive, operate passively and can operate effectively for long periods with little maintenance.

The most common type of drain is a simple orifice that allows water to drain from the reservoir to an outlet which is at some lower elevation. Flow rates through the orifice depend on the size of the orifice and the height of the water in the reservoir above the level of the drain. This leads to two seemingly contradictory problems, in which actual flow rates seldom match the desired drainage rate. Very low drainage rates, such as might be desired in the case of small rainfalls being drained from small drainage basins (such as residential lots, small multiple dwelling complexes and small business lots), can only be obtained by making the orifice size very small. Because very small orifices are prone to clogging, many codes specify a minimum orifice size in order to ensure that the system operates efficiently. The result is that when draining small rainfalls from these small drainage basins, the actual drainage rates are higher than desired, because the orifice is too large to restrict the flow to the desired rate.

The converse problem is seen when larger rainfalls are experienced. In this case, drainage rates are maintained at or below the predetermined maximum drainage rate through the size of the orifice. The orifice is sized so that, at the highest water level, the flow rate through the drain is at or below the predetermined maximum. When the water level is lower than the maximum, the flow rate is reduced. This means that for larger storms, the flow rates from the reservoir may be below permitted or desired rates until the reservoir is full. Because the water is not drained as rapidly as permitted, more of it is detained in the reservoir, and the reservoir must be sized to hold that additional water. The result is that the detainment systems must be oversized to hold extra water because the drainage rates are usually less than allowed. Oversizing the system increases equipment, transportation and installation costs.

It would be desirable to provide an inexpensive and reliable system for controlling the rate of discharge of a fluid from a vessel, which permits fluid discharge rates that can be made independent of the fluid level in the vessel, and which permits a wide range of flow rates to be achieved.

SUMMARY OF THE INVENTION

Figure 1:
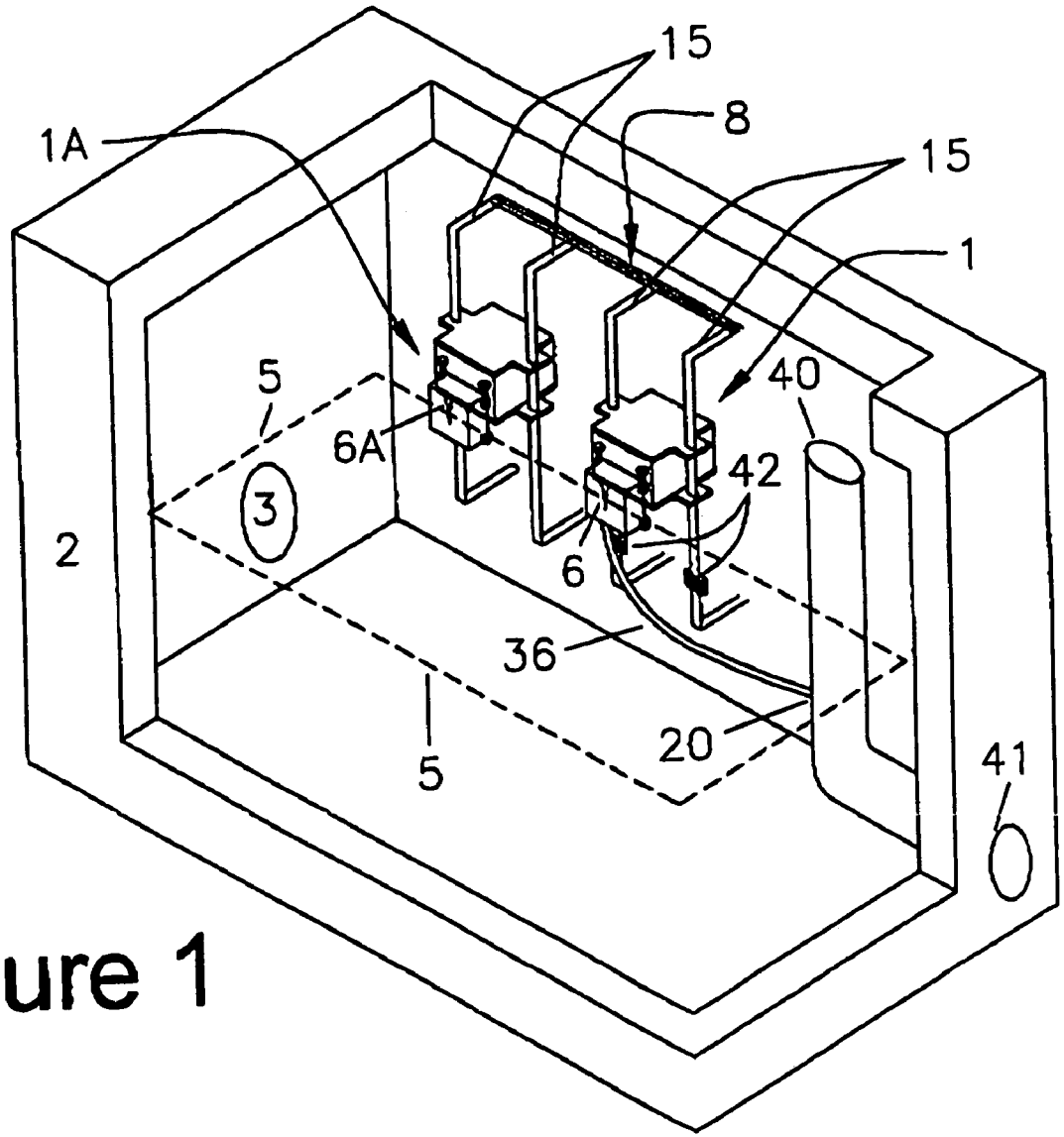
FIG. 1 is an isometric, partially cut-away view of a fluid detainment system of the invention.

In one aspect, this invention is a floating weir assembly for removing fluid from a vessel containing a fluid having a surface, comprising a) buoyancy means, and b) a fluid inlet affixed to the buoyancy means and having a weir opening to the fluid in the vessel, the weir opening being positioned such that at least a portion of the weir opening is submerged in the fluid when the floating weir assembly floats in the fluid and being vertically adjustable with respect to the surface of the fluid in a vessel containing the floating weir assembly such that the portion of the weir opening that is submerged is controllable through vertical adjustment of the weir opening, and wherein the fluid inlet has an exit opening for connection to a fluid outlet from the vessel.

The weir assembly of this invention is capable of controlling the rate at which a fluid is removed from a container in a manner that is adjustable and independent of the fluid level in the vessel. As described below, it is capable of being modified so that the fluid is removed at increasing rates as the fluid level in the vessel increases. The weir assembly floats at the surface of the fluid in the vessel. The fluid inlet is positioned such that at least a portion of the weir opening is below the surface of the fluid in the vessel, so that the fluid enters the weir opening and drains from the vessel through the vessel's fluid outlet.

The weir opening is vertically adjustable with respect to the surface of the fluid in the vessel. Because of this, its height can be adjusted so that more or less of the weir opening is submerged in the fluid, and the rate at which the fluid passes through the opening and enters the fluid inlet is adjusted accordingly. For preferred open channel systems, where the fluid path from the weir opening to the vessel fluid outlet is open to the atmosphere, the maximum drainage rate is achieved when approximately 90% of the area of the weir opening is below the surface of the fluid. By raising the fluid inlet so less of the weir opening is submerged, any lesser drainage rate can be specified. Because the weir assembly floats, the fluid inlet (and the weir opening) can be maintained at a constant position relative to the surface of the fluid. Drainage rates are in this case independent of the level of fluid in the vessel whenever the fluid level is sufficient to float the floating weir assembly. The fluid inlet and the weir opening can therefore be designed so that the maximum allowable flow (or any other desired flow rate) is achieved at all times, once enough fluid is present to float the weir assembly.

Thus, this invention provides a passive device through which fluid can be drained from a vessel at a predetermined rate. The device can accommodate a wide range of flow rates, depending on the weir opening size and geometry and the position of the weir opening relative to the surface of the fluid in the vessel. Very small flow rates can be obtained through proper sizing and positioning of the weir opening. Conversely, the maximum desired flow rates can be obtained, essentially independently of the fluid level in the vessel, again by manipulating the size and position of the weir opening.

In another aspect, this invention is a floating weir assembly for removing fluid from a vessel containing a fluid having a surface, comprising a) buoyancy means b) a fluid inlet affixed to said buoyancy means such that a weir opening of the fluid inlet is maintained at a predetermined position relative to the surface of the fluid in the vessel and is at least partially submerged when the floating weir assembly floats in the fluid in the vessel, and wherein the fluid inlet has an exit opening for connection to a fluid outlet from the vessel.

As with the weir assembly of the first aspect of the invention, this weir assembly is capable of controlling the rate at which a fluid is removed from a vessel in a manner that is independent of the fluid level in the vessel. The weir assembly floats at the surface of the fluid in a vessel. As before, the fluid inlet is positioned such that at least a portion of the weir opening to the fluid inlet is submerged, so that the fluid enters the fluid inlet and drains from the vessel through the vessel's fluid outlet. The weir opening may be wholly submerged, in which case the weir opening is sized so that flow into the inlet is restricted by and therefore controlled by the size of the weir opening. Alternatively, the weir opening may be partially submerged, in which case flow rates into the fluid inlet are controlled by the area of the weir opening beneath the surface of the fluid.

In this second aspect, the weir opening may or may not be vertically adjustable with respect to the surface of the fluid in the vessel (and/or the buoyancy means). If the entire weir opening is submerged, the ability to adjust it vertically does not affect the surface area of the weir opening that is exposed to the fluid. However, in that case, vertical adjustment can nonetheless affect flow rates into the weir opening by increasing or decreasing the head pressure. Head pressure is increased by submerging the weir opening more deeply below the surface of the fluid, and head pressure is decreased by adjusting the weir opening to be closer to the surface of the fluid. Because the weir assembly floats, the weir opening is maintained at a constant position relative to the surface of the fluid as the fluid level rises and falls, and the flow rates through the weir opening and into the fluid inlet are therefore independent of the level of fluid in the vessel when the floating weir assembly is floated. Also as before, the floating weir assembly of this aspect can accommodate a wide range of desired flow rates.

In this second aspect of the invention, the size of the weir opening may be adjustable to provide a means by which to further control the rate of fluid flow through the weir opening and into the fluid inlet. In embodiments in which the weir opening is not vertically adjustable, providing size adjustment means in this manner provides an alternative way of controlling flow rates into the fluid inlet.

In another aspect, this invention is a fluid container comprising a vessel for containing a fluid and a floating weir assembly of either of the first two aspects, in which the fluid inlet of the floating weir assembly is in fluid communication with a fluid outlet from the vessel, such that the rate of flow of the fluid from the vessel through the floating weir assembly is limited by the rate of flow of the fluid into fluid inlet through the weir opening. In yet another aspect, this invention is a method of controlling the rate of flow of a fluid from a vessel, in which the vessel contains a floating weir assembly of either of the first two aspects that is floating on the surface of a fluid in the vessel, and the fluid inlet of the floating weir assembly is in fluid communication with a fluid outlet from the vessel, such that the rate of flow of the fluid from the vessel is limited by the rate of flow of the fluid into fluid inlet through the weir opening. In yet another aspect, this invention is a rainwater detention system, comprising a rainwater containment vessel having a rainwater inlet into the vessel and a floating weir assembly of either of the first two aspects, in which the fluid inlet of the floating weir assembly is in fluid communication with a rainwater outlet from the vessel, such that the rate of flow of the rainwater from the vessel through the floating weir assembly is limited by the rate of flow of the rainwater into the fluid inlet through the weir opening.

DETAILED DESCRIPTION OF THE INVENTION

FIG. 1 illustrates an embodiment of the invention. In FIG. 1, floating weir assemblies 1 and 1A are disposed in vessel 2. Vessel 2 is partially filled with a fluid having a surface indicated by line 5. Fluid enters vessel 2 through fluid entrance 3. Floating weir assemblies 1 and 1A are mounted on optional support rack assembly 8. Each floating weir assembly includes a weir opening (6 and 6A, respectively) through which fluid enters the fluid inlet for removal from the vessel. The height of weir openings 6 and 6A are adjusted such that at least a portion of each of them is submerged below surface 5. Fluid entering weir opening 6 drains from vessel 2 by entering fluid inlet 17 (FIG. 2) and draining out of exit opening 50 into hose 36 through joint 20 into drainpipe 40. Fluid entering drainpipe 40 is removed from vessel 2 through fluid outlet 41.

Figure 2:
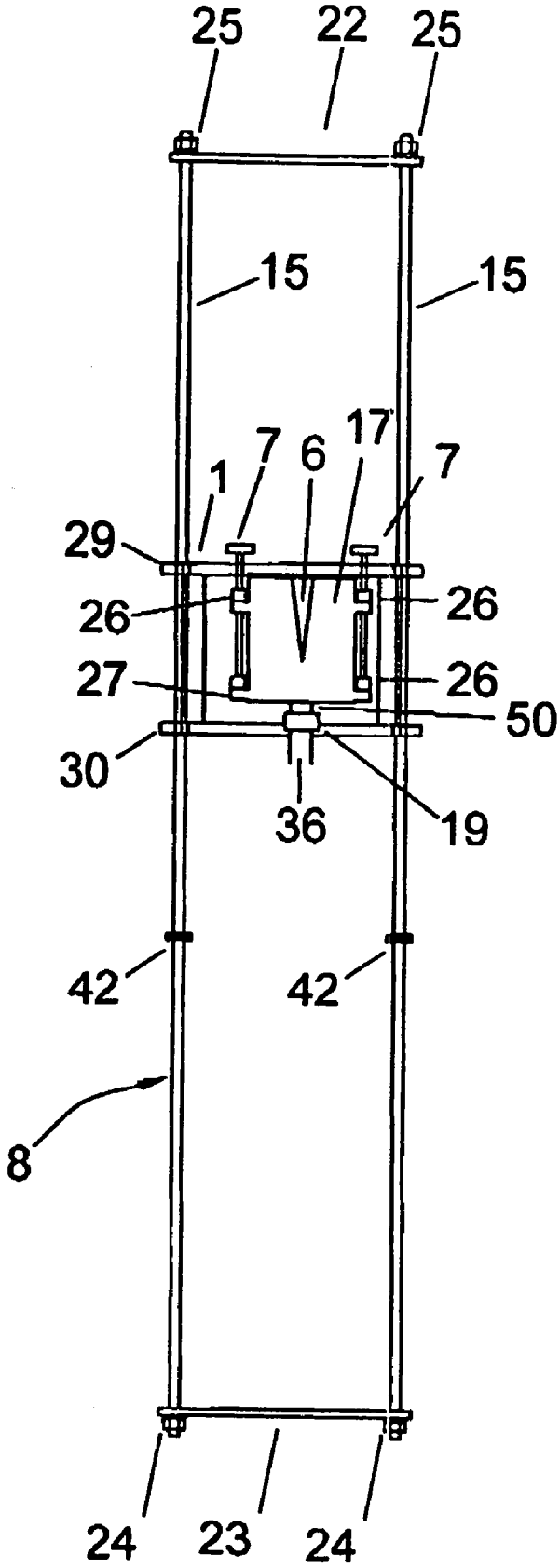
FIG. 2 is a front view of an embodiment of a floating weir assembly of the invention and an optional support assembly.
Figure 3:
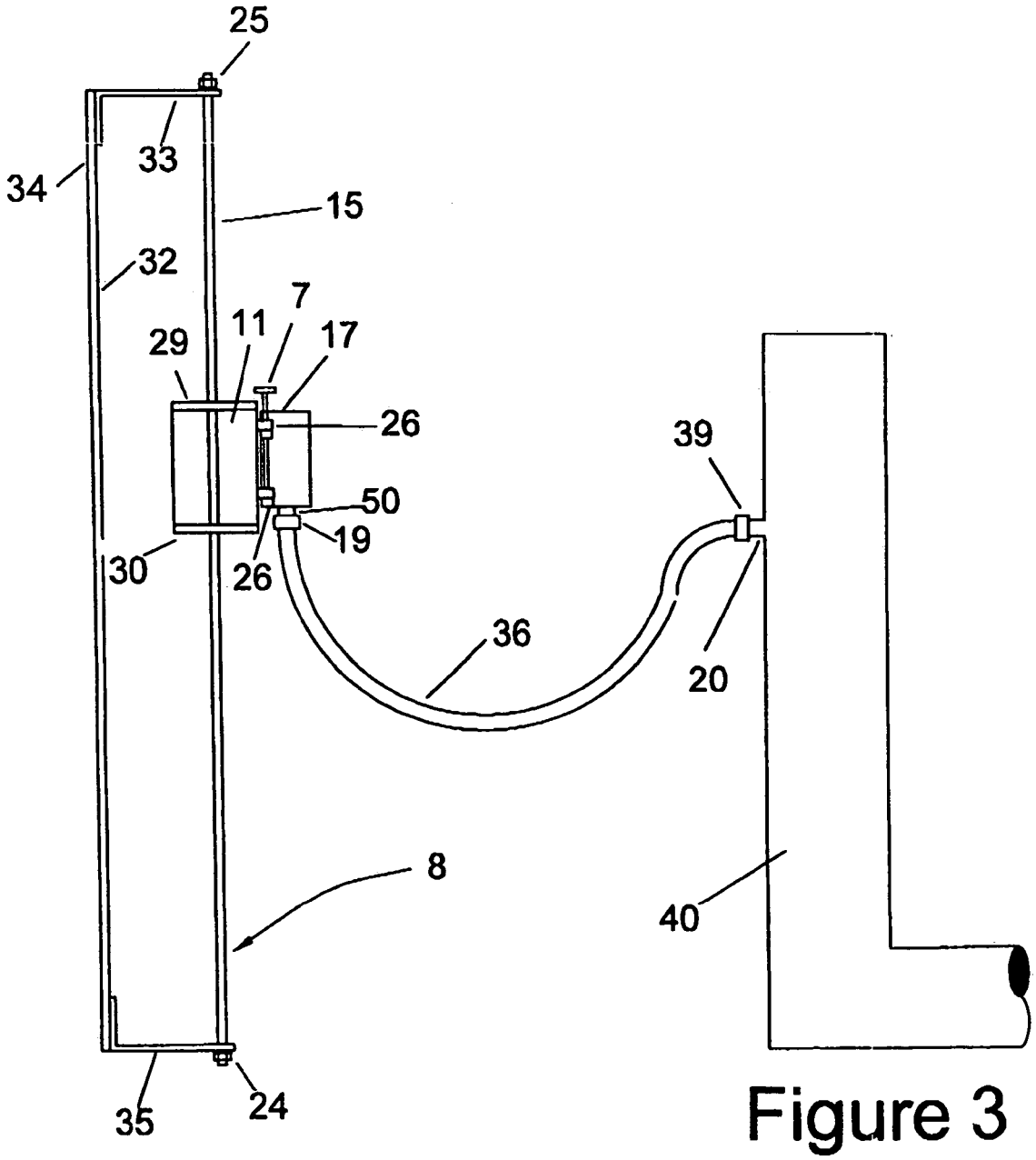
FIG. 3 is a side view of the embodiment of a floating weir assembly of the invention shown in FIG. 2, and an optional support assembly.

Turning to FIGS. 2 and 3, floating weir assembly 1 is seen to include buoyancy means 11 and fluid inlet 17. Buoyancy means 11 is a device which is less dense than the fluid in the vessel and provides enough buoyancy that the floating weir assembly floats at the surface of the fluid. By "at the surface", it is meant that at least a portion of the floating weir assembly is held above the fluid surface level as the floating weir assembly floats. Buoyancy means 11 preferably provides a buoyancy of at least 1.5 times, more preferably at least 3 times, even more preferably at least 4 times the weight of the floating weir assembly, so it maintains a constant position atop fluid surface 5. As shown, buoyancy means 11 is a gas-filled container. The gas is suitably air, although any gas can be used. The body of buoyancy means 11 can be made of any material that is impervious to the gas and to the fluid in the vessel, such as a metal (such as aluminum, steel, stainless steel, magnesium, copper, and the like) a plastic (such as polystyrene, ABS resin, polyethylene (including high density, low density, linear low density, and substantially linear types), polycarbonate, polypropylene, and the like), a natural or synthetic rubber (such as a styrene-butadiene rubber or a polyurethane), a thermoset resin (such as an epoxy or polyurethane), wood or other material. Alternatively, buoyancy means 11 may contain a polymer foam instead of a gas, with an impervious body as before. Buoyancy means 11 may consist, for example, of a skinned polymer foam, such as a skinned polyurethane foam or a closed-cell thermoplastic foam such as a closed-cell extruded polyethylene or polypropylene foam. Buoyancy means 11 may also consist of or contain a non-gaseous material, impervious to the fluid, which has a lower density than the fluid. For example, buoyancy means 11 may consist of a body containing a low-density liquid, such as a liquid hydrocarbon, or may be made entirely of a low-density material, such as wood or low density thermoplastic polymer.

In the embodiment shown in FIGS. 1–3, fluid inlet 17 is attached to buoyancy means 11 and is vertically adjustable relative to buoyancy means 11 and to fluid surface 5. As shown in more detail in FIGS. 2 and 3, fluid inlet 17 is adjustable via brackets 26 and adjustment screws 7. Portions of brackets 26 affixed to buoyancy means 11 are threaded, so that by turning adjustment screws 7, fluid inlet 17 is moved upwardly or downwardly relative to buoyancy means 11. This has the effect of changing the area of weir opening 6 that is submerged beneath fluid surface 5. By pushing more of weir opening 6 beneath fluid surface 5, flow into fluid inlet 17 is increased and flow rates into fluid inlet 17 are increased proportionately. Similarly, flow rates through weir opening 6 can be decreased by pulling more of it above fluid surface 5. The flow rates through each of floating weir assemblies 1 and 1A may therefore be adjusted to any predetermined value through proper sizing of weir openings 6 and 6A and proper adjustment of the positions of weir openings 6 and 6A relative to the surface of the fluid in the vessel.

In addition to the adjustment screw arrangement shown in FIGS. 2 and 3, a variety of other adjustment means can be used, such as a rod and sliding plate assembly with set screws, adjustment motors and other mechanical adjustment means as are well known in the art. The adjustment means may be automated and/or remote-controlled, if desired.

Although the weir opening to the fluid inlets may be of any convenient shape, such as circular, rectangular, square, rhombic, triangular and the like, a Cipoletti weir, particularly a triangular Cipoletti weir, has the advantages of providing for accuracy, wide rangeability (i.e., wide range of allowable flow rates) and linear response. In the embodiment shown in FIGS. 1–3, weir openings 6 and 6A are triangular Cipoletti weirs having a base angle of 28°. Weir openings 6 and 6A are oriented vertically, or at least at an angle to the horizontal, so that adjusting them upwardly or downwardly will cause flow rates into fluid inlet 17 to vary in relation to the submerged area of the weir openings.

Fluid inlet 17 is in fluid communication with fluid outlet 41 through which the fluid exits the vessel. As the floating weir assembly will rise and fall with the fluid level in the vessel, the fluid path from fluid inlet 17 to fluid outlet 41 preferably includes some flexible material that can accommodate the movement of the weir. As shown in FIG. 3, this is accomplished through hose 36, which is connected to the corresponding fluid inlet 17 through coupling 19 (which may be, for example, a swing coupling such as an Oetiker SC swing coupling or other coupling which accommodates the movement of the floating weir assembly). Hose 36 is connected to drainpipe 40 via a second coupling 39, which may also be a swing coupling or other coupling which accommodates the movement of the floating weir assembly.

The flow path from fluid inlet 17 through fluid outlet 41 is designed without bottlenecks, so that fluid entering weir opening 6 is conducted out of vessel 2 through opening 41 at least at the rate at which the fluid enters fluid inlet 17 through weir opening 6. In general, this means that the flow path is oversized at all points downstream of opening 6, relative to the volume of flow through weir opening 6. Designing the system in this way accomplishes at least three beneficial results. First, flow rates can be specified by the size and position of weir opening 6. Second, flow rates can remain independent of the fluid level in the vessel. Third, gases that may be entrapped downstream of the fluid inlet can easily escape through weir opening 6 (or, in some embodiments, the top of drainpipe 40) without interfering with the operation of the system.

The fluid path from fluid inlet 17 to fluid outlet 41 is preferably gravity-fed, without additional pumps or other means for increasing fluid flow out of the vessel. In addition, the fluid path is preferably an open-channel system that is exposed to the atmosphere. This can occur at one or more places, such as at weir opening 6 (when partially submerged under surface 5), at drainpipe 40 (which as shown extends above surface 5) or downstream of fluid outlet 41. As mentioned before, the fluid path from fluid inlet 17 to fluid outlet 41 is preferably oversized relative to the flow rate of fluid entering weir opening 6. It is preferred that the capacity of the fluid path is at least 10% greater than the maximum intended rate of flow of the fluid into weir opening 6. For reasons of cost, it is preferred that the capacity of the fluid path from fluid inlet 17 to fluid outlet 41 is not greater than 200% of the maximum intended rate of flow into weir opening 6, especially not greater than 150% thereof In the embodiment shown in FIGS. 1–3, an optional support rack assembly 8 is provided to support the floating weir assemblies 1 and 1A. In the embodiment shown, support rack assembly 8 performs two optional but preferred functions—it maintains floating weir assembly 1 in a constant orientation within vessel 2, and maintains floating weir assembly in a fixed horizontal position within vessel 2. As shown in FIGS. 1–3, support rack assembly 8 includes guide rods 15, horizontal members 22 and 23, angled members 33 and 35, and a plurality of vertical supports 34. Floating weir assembly 1 is slidably affixed to guide rods 15 via top bracket 29 and bottom bracket 30. In the embodiment shown, brackets 29 and 30 each have holes through which guide rods 15 are passed. The holes are large enough that floating weir assembly 1 moves up and down easily with rising and falling fluid levels in the vessel. As shown, guide rods are 15 are threaded at top and bottom, inserted through holes in horizontal members 22 and 23, and held in place with nuts 24 and 25. Angled members 33 and 35 connect guide rods 15 to vertical supports 34. Vertical supports 34 may be used to anchor support rack assembly 8 in place within vessel 2.

Alternatively, guide rods 15 can be replaced with a single guide rod (or any greater number of guide rods). The guide rod(s) may run through buoyancy means 11, rather than beside it as shown.

Other means for maintaining the floating weir assembly in the desired orientation can be used instead of the support rack assembly shown in FIGS. 1–3. For example, the floating weir assembly may simply be weighted at the bottom. It may be tethered (through a chain, cable, rope or the like) to the top or bottom of vessel 2. The floating weir assembly may be enclosed in a perforated, vertical guide tube. Magnetic guides may also be used to maintain the floating weir assembly in the desired orientation.

Similarly, other means for maintaining the floating weir assembly in a desired horizontal position in the vessel can be used. The floating weir assembly, for example, may be contained in a segregated area of the vessel, using a wide variety of physical devices which allow fluid communication into the segregated area, such as fencing, partitions, gratings, tethers to the floating weir assembly (such as ropes, cables, chains, etc.), perforated guide tubes, magnetic guides and the like. As is apparent, many devices will perform both the function of maintaining the floating weir assembly in a desired orientation and maintaining it in a desired horizontal position.

When a fluid is in vessel 2, floating weir assembly 1 floats on fluid surface 5, so that a predetermined portion of weir opening 6 is submerged in the fluid, and the fluid enters weir opening 6 at predetermined rate. This rate is set to a predetermined value by vertically adjusting weir opening 6 so that more or less of it is submerged below fluid surface 5. Fluid outlet 41 is located below weir opening 6, so fluid entering weir opening 6 is gravity-fed through fluid inlet 17 and hose 36 through outlet 41.

Drainpipe 40 is optional, and hose 36 may be connected directly to fluid outlet 41 or some other fluid outlet. In the embodiment shown in FIG. 1, drainpipe 40 provides an additional opening to the atmosphere and also allows fluid flowing back into vessel 2 through opening 41 (such as may be encountered in drainage system overflow conditions or flooding) to re-enter vessel 2.

It will be appreciated that as the fluid level rises in vessel 2, floating weir assembly 1 will rise and more of hose 36 will be lifted. This may increase the weight supported by buoyancy means 11. If this weight increase is significant, it may affect the height of weir opening 6 relative to fluid surface 5 and therefore affect flow rates. This effect can be minimized or eliminated in several ways. Hose 36 (or other conduit between fluid inlet 17 and drainpipe 40) can be made of a material that closely matches the density of fluid 4, so that the load changes on floating weir assembly 1 as hose 36 is lifted are minimal or eliminated. Buoyancy means 11 can provide large excess buoyancy (as described above), relative to the total load and the changes in load as hose 36 is lifted, so the effect of lifting the hose is negligible. The weight of hose 36 may be supported by various types of mechanical means.

Two or more floating weir assemblies may be employed in a vessel if desired, although in many cases a single floating weir assembly is suitable. The embodiment shown in FIG. 1 illustrates an optional feature, in which floating weir assembly 1 is set to operate only when the fluid level reaches a certain pre-determined minimum height in vessel 2. This is accomplished by providing means restricting the downward movement of floating weir assembly 1, so that weir opening 6 is held above the level of the fluid until the fluid level reaches some predetermined height. In FIGS. 1 and 2, this restricting means is in the form of stops 42, which are positioned on guide rods 15 and are larger than the holes in bracket 30 that affixes floating weir assembly 1 to guide rods 15, so that bracket 30 cannot pass below stops 42. Alternative means of restricting the downward movement of the floating weir assembly include, for example, a ledge or support located in the vessel under the floating weir assembly, a tether of a predetermined length that connects the floating weir assembly to the roof of the vessel, and the like.

The two-weir embodiment of FIG. 1 permits fluid to be drained at a first, predetermined rate through floating weir assembly 1 until the fluid level reaches some predetermined level. At that point, fluid begins to drain through floating weir assembly 1A as well, so that the flow rate out of vessel 2 then equals the combined flow rates through floating weir assemblies 1 and 1A. Of course, this concept can be extended to any number of floating weir assemblies, any number of which can have restricted movement so that they only become operative when the fluid level in the vessel reaches one or more predetermined values. It is also possible to provide multiple floating weir assemblies of the invention, all of which operate at any fluid level.

Figure 6:
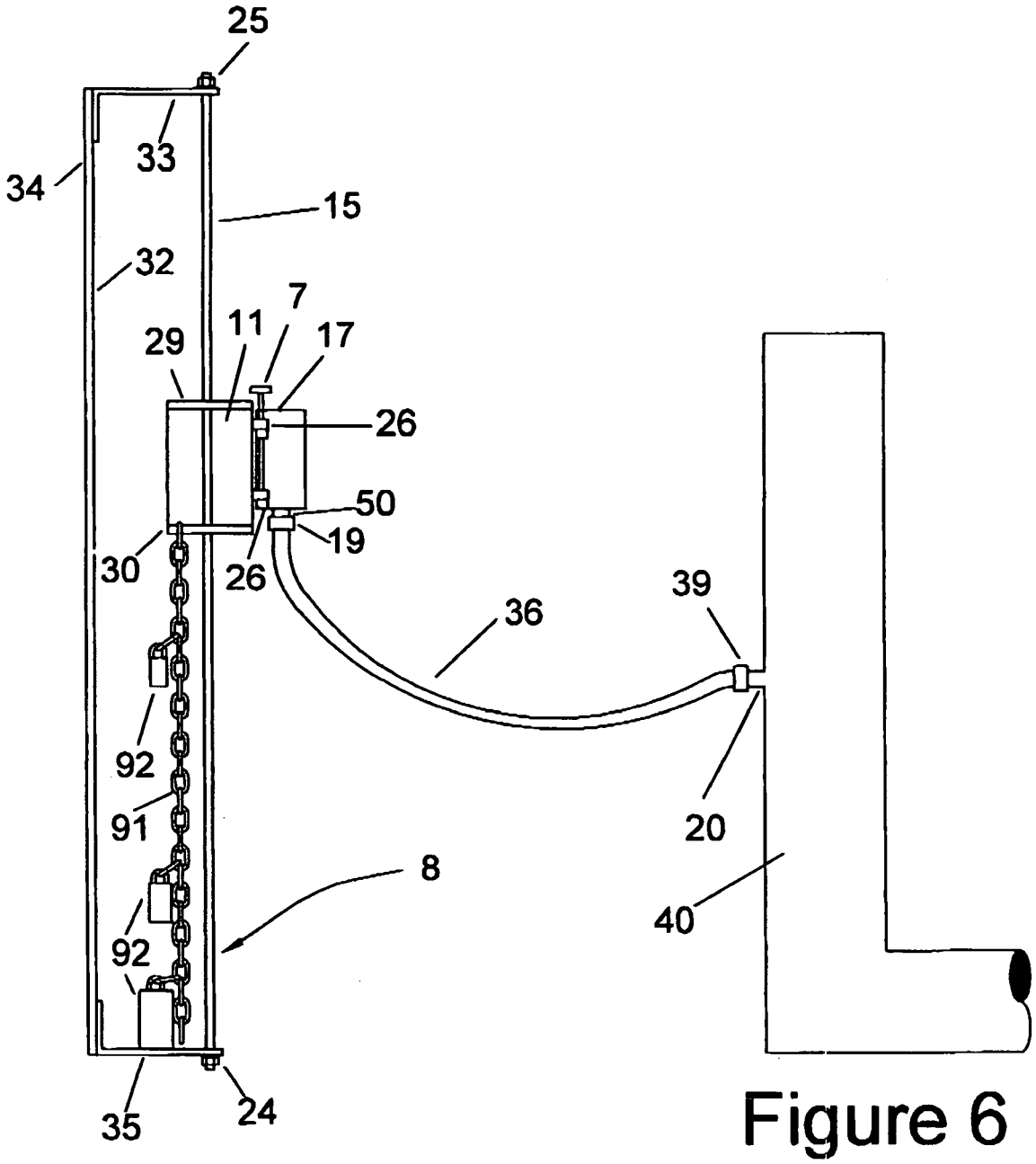
FIG. 6 is a side view of an embodiment of a floating weir assembly of the invention, with an optional support assembly and an optional ballast assembly.

FIG. 6 illustrates a floating weir assembly of the invention of the type illustrated in FIGS. 1–3, which is further adapted to allow the rate of fluid removal to increase with increasing fluid level in the vessel. In the embodiment shown, this is accomplished by affixing a series of weights 92 to the floating weir assembly via an attachment means 93, which may be, for example, a cable, cord, rope or chain. Attachment means 93 is long enough so that, at lower fluid levels, at least some of weights 92 rest on the bottom of the vessel. As the fluid level rises and the floating weir assembly rises, weights 92 are successively lifted from the bottom of the vessel, thereby increasing the load on buoyancy means 111. The increased load causes the weir opening to become more and more submerged in the fluid as more weights are lifted, each time increasing the rate of flow of the fluid into the opening and out of the vessel. In effect, ballast is added to and removed from the floating weir assembly in response to changes in fluid level. Other means for adjusting ballast in relation to the level of fluid in the vessel can be substituted for the weight and attachment means system shown in FIG. 6. For example, the floating weir assembly may be connected to the bottom of the vessel through a spring assembly. Following Hook's law, the load provided by the spring will increase in proportion to the strain induced by the floating weir assembly as it is borne upward with increasing fluid levels in the vessel. Similarly, a piston-and-cylinder assembly connected between the floating weir assembly and either the top or bottom (or both) of the vessel can cause gas to be compressed within the cylinder as the floating weir assembly rises, effectively providing ballast which causes more of the weir opening to be submerged as the floating weir assembly rises.

Figure 4:
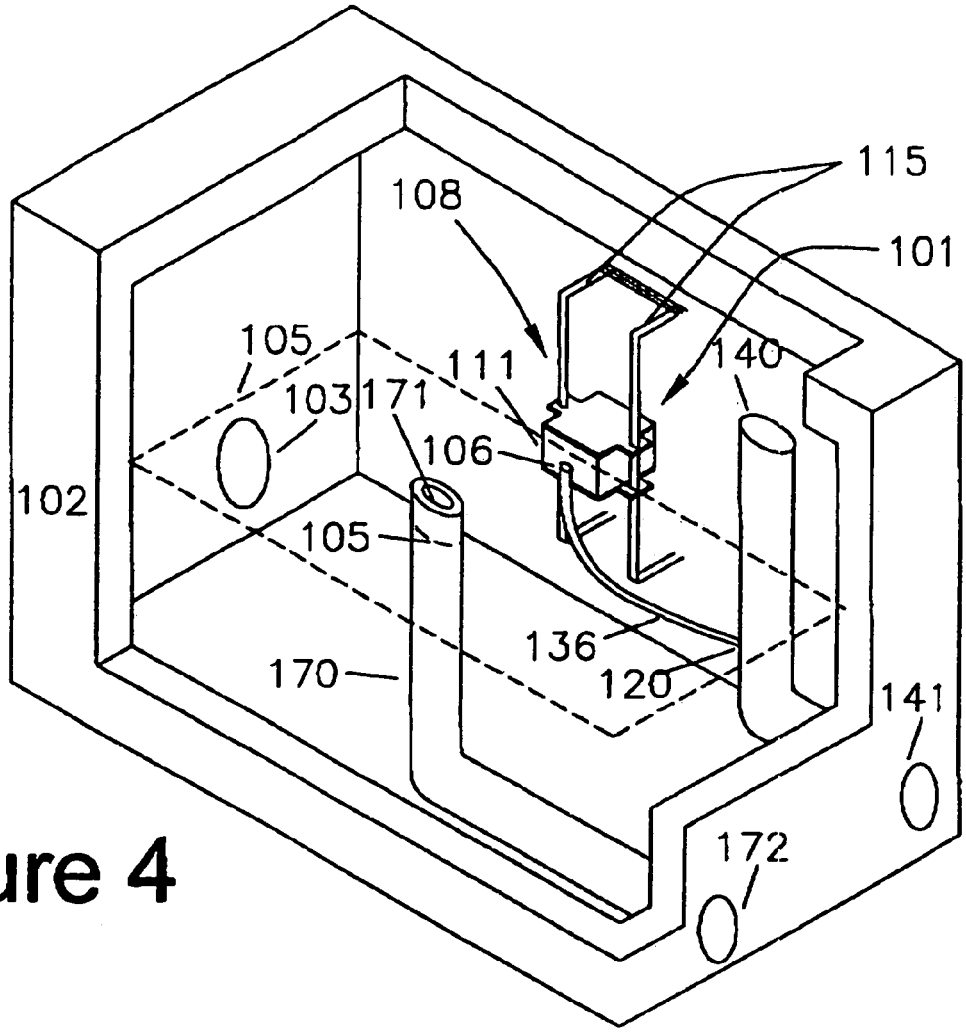
FIG. 4 is an isometric, partially cut-away view of a second embodiment of a fluid detainment system of the invention.
Figure 5:
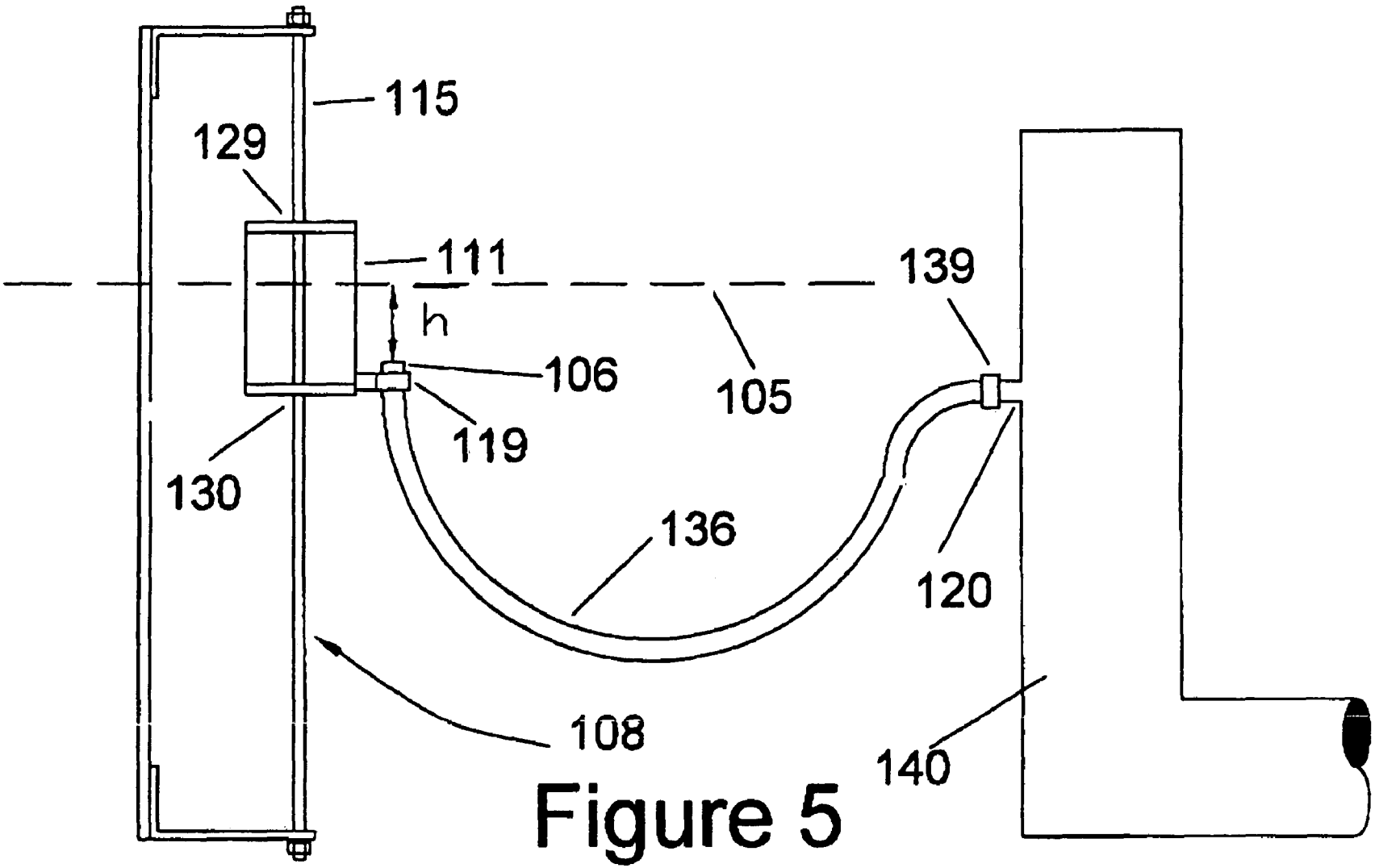
FIG. 5 is a side view of a second embodiment of a floating weir assembly of the invention and an optional support assembly.

FIGS. 4 and 5 illustrate another aspect of the invention. In FIG. 4, floating weir assembly 101 is disposed in vessel 102. Vessel 102 is partially filled with a fluid having a surface indicated by line 105. Fluid enters vessel 102 through entrance 103. Floating weir assembly 101 is mounted on optional support rack assembly 108. Floating weir assembly 101 includes weir opening 106 through which fluid enters the weir. As shown, entire weir opening 106 is submerged below fluid surface 105. Fluid entering opening 106 drains from vessel 102 through hose 136 and joint 120 into drainpipe 140. Fluid entering drainpipe 140 is removed from vessel 102 through fluid outlet 141.

In FIG. 5, floating weir assembly 101 is seen to include buoyancy means 111 and weir opening 106. Buoyancy means 111 is as described before. Weir opening 106 is attached to buoyancy means 111 such that it is maintained at a predetermined vertical position relative to buoyancy means 111 and fluid surface 105. As shown, weir opening 106 is completely submerged at a distance h below fluid surface 105. In this configuration, flow rate through weir opening 106 is controlled by the size of the opening and the head pressure generated by the height h of the fluid above weir opening 106.

In an optional embodiment of this configuration, it is possible to adjust flow rates by vertically adjusting weir opening 106 with respect to buoyancy means 111 and fluid surface 105, thereby adjusting the head pressure. Adjustment means as described before are suitable. Another way of adjusting flow rates is to make the size of weir opening 106 is adjustable, so that flow rates through weir opening 106 can be controlled though adjustments to the size of weir opening 106. For example, weir opening 106 may contain an adjustable shutter or iris which can close off all or a portion of weir opening 106, or in the case of a triangular and/or Cipoletti weir may have an adjustable angle of opening. A ballast adjusting means as described before can also be used to adjust the distance h in relation to changing fluid levels in the vessel, thereby changing drainage rates.

In an alternate but preferred embodiment, opening 106 may be only partially submerged. In this case, flow rates are controlled by the area of opening 106 that is submerged. This can be done in several ways. The floating weir assembly may include adjustment means, as described before, so that opening 106 is vertically adjustable relative to buoyancy means 111 and fluid surface 105, and flow rates through opening 106 are controlled by adjusting the area of opening 106 that is submerged. Another way is to adjust the buoyancy provided by buoyancy means 111 by, for example adjusting gas pressure within buoyancy means 111 (pressurizing to submerge more or depressurizing to raise weir opening 106), adding or removing ballast, and the like. Yet another way is to use a ballast adjusting means as described before. In addition to or instead of these approaches, the size of weir opening 106 can be made adjustable in ways described before, so that flow rates through weir opening 106 can be controlled though adjustments to the size of weir opening 106.

As before, weir opening 106 is in fluid communication with fluid outlet 141 through which the fluid exits vessel 102. As shown in FIG. 5, this is accomplished through hose 136, which is connected to opening 106 through coupling 119. Hose 136 is shown in FIG. 5 connected to drainpipe 140 via a second coupling 139 at joint 120. Fluid entering drainpipe 140 exits vessel 102 through fluid outlet 141.

Optional support rack assembly 108 performs the same function as support rack assembly 8 in FIGS. 1–3. Floating weir assembly 101 is slidably affixed to the guide rods 115 via top bracket 129 and bottom bracket 130, in the manner described before.

FIG. 4 illustrates how the floating weir assembly of this invention can operate in conjunction with conventional orifice-type drains. Drain 170 includes orifice 171, which is raised in relation with the floor of the vessel. Drain 170 is in fluid communication with outlet 172. In the configuration shown in FIG. 4, drainage is provided solely through floating weir assembly 101 unless fluid level 105 surpasses the height of drain 170. Once that happens, additional drainage is provided through drain 171, with the rate of outflow through drain 170 being controlled though the size of orifice 171. Of course, flow rates through orifice 171 will depend on the fluid level inside vessel 102, but flow rates through floating weir assembly 101 can be made independent of fluid level.

The floating weir assembly may of course include various optional features, such as shut-off valves, remote-controlled valves or other controls, screens or other devices to prevent foreign material from entering the weir opening and impairing the performance of the device, sensors that determine and optionally report the working status of the device (such as position sensors and the like), and other controls.

The floating weir assembly of the invention is useful in a wide variety of applications. Of particular interest are applications in which passive, low maintenance flow control is desired, and applications in which fluid levels in a vessel are variable but outflow is nonetheless desirably constant.

An application of particular interest is in a rainwater detention system. In such a system, the vessel is typically a vault (such as illustrated in FIGS. 1 and 4) which collects rainwater and controls its outflow, typically to a storm sewer system but sometimes to adjacent, lower elevation areas. In these systems, outflow rates are often regulated. The position and size of the weir openings will therefore be selected together to achieve the desired outflow rates. The floating weir assembly of this invention can be used to provide very low outflow rates when small amounts of rainwater are accumulated in the vessel. Alternatively, it can be used to control maximum outflow rates when larger amounts of rainwater accumulate. The passive operation provided by the floating weir assembly allows it to be operable even when electrical power is lost, which happens frequently during storm conditions.

Another application of interest is agricultural irrigation systems. Many agricultural fields are irrigated through a complex of irrigation ditches, which are connected to a main irrigation canal through a sluice gate. Farmers introduce water into their irrigation ditches by opening the sluice gates and allowing water to flow from the irrigation canal. However, the water level in the irrigation canal usually not in the control of the farmer, but is instead controlled by other factors such the amount (and timing) of precipitation upstream, the operation of gates, levees and/or dams up- or downstream (such as by water control authorities) and other factors. Once the sluice gate is opened, water flow into the irrigation ditch is often subject to changes in the water level in the canal. Unexpected rises in the water level in the canal can result in flooded irrigation ditches and fields, and unexpected decreases in the water level can result in inadequate irrigation. The floating weir assembly of this invention solves this problem. It is floated in the irrigation canal (which serves as the vessel in this application), with the fluid inlet being in fluid communication with an outlet to the irrigation ditch. Water is supplied to the irrigation ditch at a predetermined rate that is independent of water level in the canal. In this application, the floating weir assembly and/or fluid path to the irrigation ditch is preferably equipped with a valve that allows the water flow to be started and stopped as desired. The valve in may be remote controlled so it can be operated from a distance. Alternatively, the valve may be operated on a timer, so that the time of day of its operation, or the amount of time it is operated, is controlled by the timer.

Another application is in municipal water systems. These typically include a water tower, into which water is pumped and stored. The height of water in the tower often dictates the water pressure that is provided to the system. Variations in water pressure are eliminated by controlling outflow with a floating weir assembly of the invention.

Other applications of interest include cases in which fluid is provided to several distinct applications from a single reservoir, or to divert a small stream from a larger flow of fluid. This is a common occurrence at chemical plants and refineries, in which a single storage tank may hold a fluid that is used at several places in the facility. A floating weir assembly can be used in such a storage vessel to provide a controlled flow of the fluid for a particular application. Multiple floating weir assemblies can be used to provide different flow rates simultaneously for different applications. As before, the floating weir assemblies operate passively and so can provide constant flow rates even in the absence of electrical power.

Having described the invention generally, it will be recognized that various modifications can be made thereto without departing from the scope thereof as limited only by the appended claims.

What is claimed is:

1. A floating weir assembly for removing fluid from a vessel containing a fluid having a surface, comprising a) buoyancy means and b) a fluid inlet affixed to the buoyancy means and having a weir opening to the fluid in the vessel, the weir opening being positioned such that at least a portion of the weir opening is submerged in the fluid when the floating weir assembly floats in the fluid and the weir opening being vertically adjustable with respect to the surface of the fluid in a vessel containing the floating weir assembly and to the buoyancy means such that the portion of the weir opening that is submerged is controllable through vertical adjustment of the weir opening, and wherein the fluid inlet has an exit opening for connection to a fluid outlet from the vessel.

2. The floating weir assembly of claim 1, further comprising a fluid path for connecting the exit opening in fluid communication to a fluid outlet from the vessel, wherein the rate of flow of the fluid from the vessel through the floating weir assembly is limited by the rate of flow of the fluid into the fluid inlet through the weir opening.

3. The floating weir assembly of claim 2, wherein the fluid path is gravity-fed.

4. The floating weir assembly of claim 2, wherein the fluid path is an open-channel system.

5. The floating weir assembly of claim 2, wherein the buoyancy means provides a buoyancy of at least 3 times the weight of the floating weir assembly.

6. The floating weir assembly of claim 1 wherein the buoyancy means includes a gas-filled container or a polymer foam.

7. A vessel for containing a fluid having a floating weir assembly of claim 1 disposed within the vessel, wherein the fluid inlet of the floating weir assembly is in fluid communication with a fluid outlet from the vessel, such that the rate of flow of the fluid from the vessel through the floating weir assembly when the floating weir assembly is floated by the fluid in the vessel is limited by the rate of flow of the fluid into the fluid inlet though the weir opening.

8. The vessel of claim 7 further comprising means for maintaining the floating weir assembly in a desired orientation within the vessel.

9. The vessel of claim 7 further comprising means for maintaining the floating weir assembly in a desired horizontal position within the vessel.

10. The vessel of claim 7, wherein the rate of flow of the fluid into the fluid inlet through the weir opening is independent of the level of fluid in the vessel when the floating weir assembly is floated by the fluid.

11. The vessel of claim 7, wherein the vessel is a rainwater detainment vessel.

12. The vessel of claim 7, wherein the vessel is an irrigation channel and the fluid outlet is in liquid communication with an irrigation system.

13. A method of controlling the rate of flow of a fluid from a vessel, in which the vessel contains a floating weir assembly of claim 1 that is floating on the surface of a fluid in the vessel, and the fluid inlet of the floating weir assembly is in fluid communication with a fluid outlet from the vessel, such that the rate of flow of the fluid from the vessel is limited by the rate of flow of the fluid into the fluid inlet through the weir opening.

14. The method of claim 13, wherein the rate of flow of the fluid into the fluid inlet through the weir opening is independent of the level of fluid in the vessel when the floating weir assembly is floated by the fluid.

15. A floating weir assembly for removing fluid from a vessel containing a fluid having a surface, comprising a) buoyancy means and b) a fluid inlet affixed to said buoyancy means such that a weir opening of the fluid inlet is maintained at a predetermined position relative to the surface of the fluid in the vessel and is at least partially submerged when the floating weir assembly floats in the fluid in the vessel, wherein the fluid inlet has an exit opening for connection to a fluid outlet from the vessel and further wherein the weir opening is entirely submerged when the floating weir assembly is floating on a fluid in the vessel and the fluid inlet includes adjustment means to adjust the weir opening size and thereby adjust the rate of flow of the fluid through the weir opening.

16. The floating weir assembly of claim 15, further comprising a fluid path for connecting the exit opening in fluid communication to a fluid outlet from the vessel, wherein the rate of flow of the fluid from the vessel through the floating weir assembly is limited by the rate of flow of the fluid into the fluid inlet through the weir opening.

17. The floating weir assembly of claim 16, wherein the fluid path is gravity-fed.

18. The floating weir assembly of claim 16, wherein the fluid path is an open-channel system.

19. The floating weir assembly of claim 16, wherein the buoyancy means provides a buoyancy of at least 3 times the weight of the floating weir assembly.

20. The floating weir assembly of claim 15 wherein the buoyancy means includes a gas-filled container or a polymer foam.

21. A vessel for containing a fluid having a floating weir assembly of claim 15 disposed within the vessel, wherein the fluid inlet of the floating weir assembly is in fluid communication with a fluid outlet from the vessel, such that the rate of flow of the fluid from the vessel through the floating weir assembly when the floating weir assembly is floated by the fluid in the vessel is limited by the rate of flow of the fluid into the fluid inlet through the weir opening.

22. The vessel of claim 21 further comprising means for maintaining the floating weir assembly in a desired orientation within the vessel.

23. The vessel of claim 21 further comprising means for maintaining the floating weir assembly in a desired horizontal position within the vessel.

24. The vessel of claim 21, wherein the vessel is a rainwater detainment vessel.

25. The vessel of claim 21, wherein the vessel is an irrigation channel and the fluid outlet is in liquid communication with an irrigation system.

26. A method of controlling the rate of flow of a fluid from a vessel, in which the vessel contains a floating weir assembly of claim 15 that is floating on the surface of a fluid in the vessel, and the fluid inlet of the floating weir assembly is in fluid communication with a fluid outlet from the vessel, such that the rate of flow of the fluid from the vessel is limited by the rate of flow of the fluid into the fluid inlet through the weir opening.

27. The method of claim 26, wherein the rate of flow of the fluid into the fluid inlet through the weir opening is independent of the level of fluid in the vessel when the floating weir assembly is floated by the fluid.

* * * * *